US008011311B2

(12) United States Patent
Al-Rujaib

(10) Patent No.: US 8,011,311 B2
(45) Date of Patent: Sep. 6, 2011

(54) APPARATUS AND METHOD FOR INHIBITING FOULING OF AN UNDERWATER SURFACE

(76) Inventor: Bassam E. A. Al-Rujaib, Nuzha (KW)

( * ) Notice: Subject to any disclaimer, the term of this patent is extended or adjusted under 35 U.S.C. 154(b) by 78 days.

(21) Appl. No.: 12/551,956

(22) Filed: Sep. 1, 2009

(65) Prior Publication Data

US 2011/0048309 A1 Mar. 3, 2011

(51) Int. Cl.
*C02F 1/78* (2006.01)

(52) U.S. Cl. ..... 114/222

(58) Field of Classification Search ..... 114/222; 210/170.06, 628

See application file for complete search history.

(56) References Cited

U.S. PATENT DOCUMENTS

| | | | | |
|---|---|---|---|---|
| 3,740,192 | A * | 6/1973 | Rasmussen | 422/6 |
| 3,953,328 | A * | 4/1976 | Aldag | 210/608 |
| 4,092,943 | A * | 6/1978 | Lund et al. | 114/222 |
| 6,676,837 | B2 * | 1/2004 | Keeton, Jr. | 210/620 |

FOREIGN PATENT DOCUMENTS

JP 02077392 A * 3/1990

* cited by examiner

*Primary Examiner* — Ed Swinehart

(74) *Attorney, Agent, or Firm* — Lowe Hauptman Ham & Berner, LLP

(57) ABSTRACT

An apparatus for inhibiting and removing marine deposits from a submerged portion of a boat or yacht include a submersible stainless steel frame having a plurality of sections extending longitudinally and transversely under the submerged portions of a watercraft and a plurality of nozzles disposed on said sections of the frame to direct a stream of air bubbles toward and against the submerged portion of the watercraft. The apparatus also includes an air compressor, a battery and a solar source of energy for charging the battery to power the air compressor. A plurality of valves and hoses are also provided for connecting each of the nozzles to the air compressor through one of the valves to thereby control the flow of air to each of said nozzles on each of said sections of the frame. A mechanism for positioning the frame and nozzles at about 40 cm away from the lowest point of a watercraft is provided as well as a timer for periodically starting and stopping the flow of air to the nozzles.

4 Claims, 3 Drawing Sheets

APPARATUS AND METHOD FOR INHIBITING FOULING OF AN UNDERWATER SURFACE

FIELD OF THE INVENTION

This invention relates to an apparatus and method for eliminating and/or reducing fouling of an underwater surface and more particularly to an apparatus and method for inhibiting marine growth namely algae and plankton and the information of phosphates on a submerged portion of a watercraft.

BACKGROUND FOR THE INVENTION

For many years, the owners' of boats and yachts have recognized the problem of marine growth on the submerged parts namely the hulls, propeller, propeller guard and shaft of their watercraft. This problem can be summarized in that a layer of marine algae and/or plankton and phosphate formation on the submerged part of the hull adversely affects the performance and efficiency of their vessels. This problem becomes more serious when a boat or yacht is left for periods of two or more weeks in the water without being moved. The problem is further aggravated when the boat remains in stagnant water. A fouling growth can significantly and adversely affect a boat or yacht's performance, increases fuel consumption and at times adversely affects a boat's balance when sailing. The growth can also lead to relatively extensive and expensively damage to parts of the engine or engines and at times become so serious as to cause removal of the watercraft from the water.

There are several solutions to avoid the aforementioned problem. The first and most straight forward solution is to move the boat at least twice each month and to operate the vessel at speed for at least about 5 miles over a period of at least 15 minutes. However, this is not always a practical solution. Scaling and cleaning the boat manually is another approach but can adversely affect the coating on the underside of a boat or yacht. Another approach is to remove the boat from the water, clean or scrap the hull and then apply a fresh undercoating. This approach which is generally successful is time consuming and expensive. Further, with smaller boats they can frequently be stored outside of the water, as for example on a lift.

A more recent approach for cleaning parts of the boat in water is disclosed in a U.S. Pat. No. 6,840,187 of Tible. As disclosed therein, an apparatus for cleaning the underwater portions of a boat having at least one cleaning unit with an injection element for generating a jet of cleaning fluid under high pressure and a manifold for generating jets of gas under low pressure. The manifold enables a space to be defined around the cleaning fluid jet in which space density is considerably reduced relative to the density of the surrounding water such as a space that is free or practically free from water. This space extends from the injection element to the surface for cleaning of the underwater portions. The apparatus is applicable for cleaning boats such as sail boats, motor boats and canal boats without it being necessary to take them out of the water.

A further approach for inhibiting fouling of an underwater surface is taught by Staerzl et al in U.S. Pat. No. 7,211,173. The Staerzl et al. patent discloses a marine fouling inhibiting system that includes first and second conductors which are made of a polymer matrix such as vinyl ester and a suspended conductor such as graphite powder or particles. This type of conductive material is formed to provide two sections of a boat hull so that a source of electrical current can be used to reversibly cause an electric current to flow to and from the conductive coating. The conductive coatings are electrically insulated from each other in order to force the formation of an electrical circuit which includes the two conductive coatings, the source of electrical current and the water in which the boat hull is disposed. This results in the creation of chlorine bubbles on the conductive surface. Chlorine bubbles on the boat hull surface discourage the formation of marine growth such as barnacles.

Notwithstanding the above it is presently believed that there is a need and a potential commercial market for an improved apparatus and method for inhibiting fouling of an underwater surface. It is also believed that the apparatus and method in accordance with the present invention will reduce the need for manually cleaning the underwater surfaces of boats and yachts, eliminate the need to operate watercraft periodically to avoid buildup on underwater surfaces, can be accomplished economically, will maintain the hull and engine parts in prestige condition and all of the above can be done without adversely affecting the environment.

BRIEF SUMMARY OF THE INVENTION

In essence, an apparatus for inhibiting and perhaps removing barnacles, fungi, plankton and other marine deposits from a submerged portion of a watercraft include a submersible frame. This frame is preferably made of stainless steel and includes a plurality of sections that extend longitudinally and transversely under the submerged portion of a watercraft. The apparatus also includes a plurality of nozzles disposed on the sections of the frame to direct a stream of air bubbles toward and against the submerged portion of the watercraft. In addition, a source of compressed air, a plurality of valves and hoses connect the nozzles to the source of compressed air through the valves to thereby control the flow of compressed air to each of the nozzles in each of the sections of the frame. The apparatus also includes means for positioning the frame and nozzles with respect to the submerged hull.

The invention also contemplates a method for inhibiting marine deposits or growth on a submerged portion of a boat or yacht hull that includes the engine components. The method includes the steps of providing a submersible frame having a plurality of sections that extend longitudinally and transversely under the submerged portion of the watercraft. A plurality of nozzles is also provided to direct a stream of air bubbles towards and against the submerged portion of the watercraft. Further, an air compressor and plurality of valves and hoses connects the nozzles to the air compressor through the valves to thereby control the flow of air to each of the nozzles to impact against the hull. A timer is also included as well as a battery and solar cell for charging the batter to thereby energize the air compressor.

A further step in the aforementioned method includes periodically energizing the air compressor at pre-selected times of at least twice a month for a period of at least about 10 hours. During that period a stream of air bubbles is generated and directed toward and against the hull.

The invention will now be described in connection with accompanying drawings wherein like reference numerals have been used to identify like parts.

DESCRIPTION OF THE PREFERRED EMBODIMENT OF THE INVENTION

Figure 1:
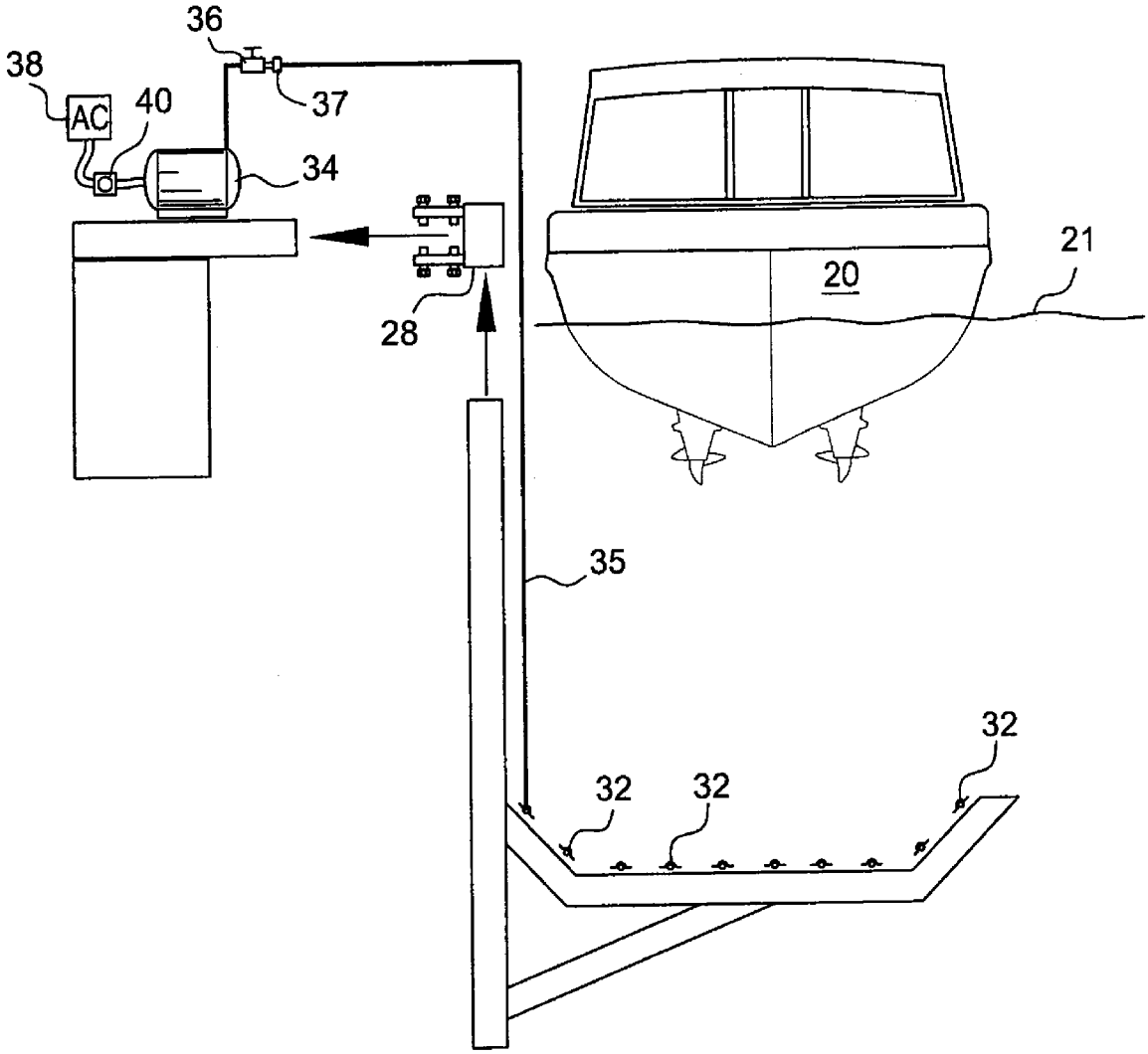
FIG. 1 is a schematic illustration of an apparatus in accordance with the first embodiment of the invention.
Figure 2:
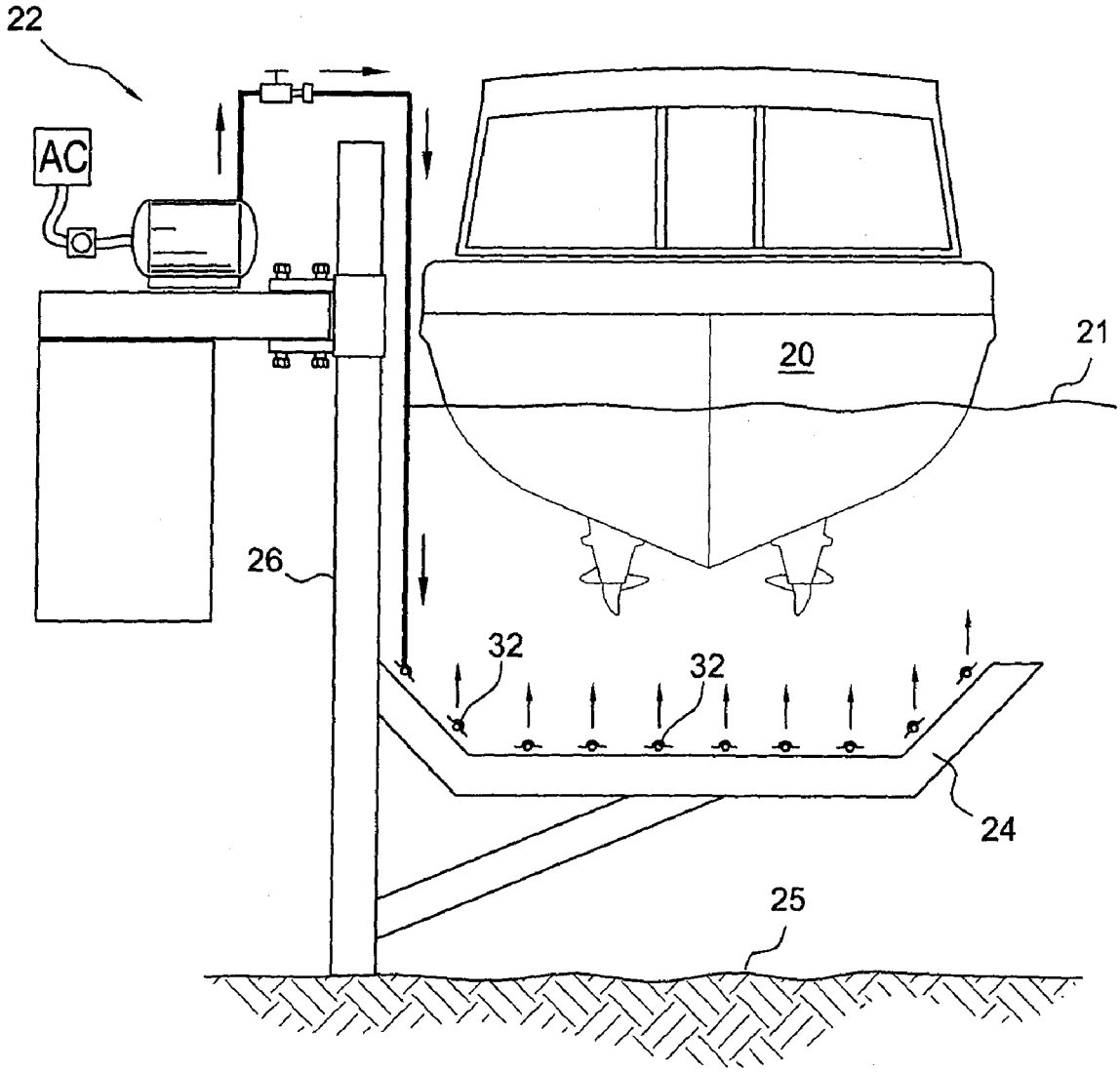
FIG. 2 is a further illustration of the apparatus shown in FIG. 1 with the frame and nozzles moved upwardly into closer proximity to a boat's hull

Referring now to FIGS. 1 and 2, a boat 20 is shown as it would appear in a front elevational view as if floated on a surface 21 of water. The boat 20 is shown in a birth equipped with an anti-fouling apparatus 22 in accordance with a preferred embodiment of the present invention. The apparatus 22 includes a frame 24 that extends forwardly and rearwardly under the surface of the water at the bottom 25 of the water. The frame 24 is fixed to a vertical support 26 that is used to raise and lower the frame 24 to accommodate boats with different drafts.

Figure 3:
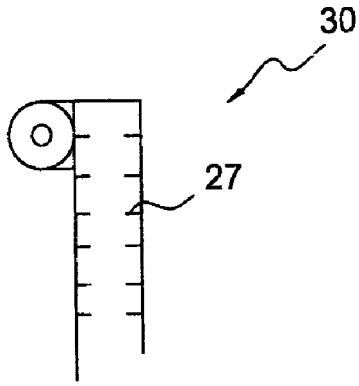
FIG. 3 is a schematic illustration of a rack and pinion assembly and markings on a vertical support as used in the present invention.

As shown, the frame 24 is fixed to the vertical support 26 that is constructed and dimensioned to lift the frame from the bed of the water to within about 40 cm from the lowest point on the boat. Means such as a clamp 28 or the like clamps the frame in an operational position. For example, a rack and pinion assembly 30 (see FIG. 3) maybe used to raise and lower the frame from near the bottom of the water to its position of about 40 cm below the lowest point of a boat 20. In practice the frame 24 remains on the bottom of the birth until a yacht or boat 20 is pulled into a birth and secured in place in a conventional manner.

Then, if the owner or authorized individual contemplates that the boat 20 will be left for a period of two or more weeks, the frame 24 is raised to its operating position and clamped in place by the clamp 28. Marks 27 (see FIG. 3) on the vertical support 26 can be used to indicate the proper position for boats with different drafts. It is also advisable to lower the frame before and after a boat enters and leaves the birth. This avoids a potentially serious problem if a boat with a larger draft enters into the birth.

A plurality of nozzles 32 are disposed about the frame and directed toward the bottom and sides of a boat 20 when raised into its operational position. The nozzles 32 are connected to an air pump 34 by a hose 35 through a valve 36 that are held in place by a hose clamp 37. The air pump 34 is connected to a source of electricity 38 or solar power. Further, a timer 40 is also provided between the source of power and the air pump.

Figure 4:
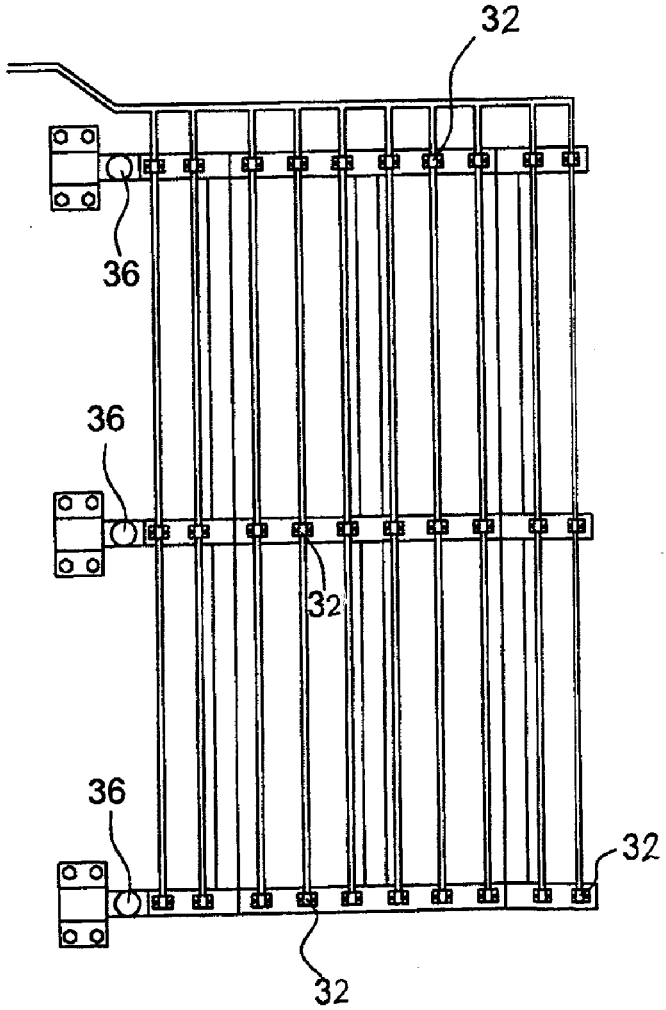
FIG. 4 is a plan view of a lower portion of a frame assembly including a plurality of nozzles and valves as submerged in water under a boat or yacht.

As shown in FIG. 4, a frame 24 includes a plurality of valves 36 for delivering air to a plurality of nozzles 30. It is also contemplated to provide a valve for each nozzle so that individual nozzles can be turned off for smaller boats. It is also contemplated that the opening and closing of an individual valve can be controlled by a timer or switchable program. Further, a series of relatively small holes 43 may be provided to allow sufficient air to escape around the frame as for example if disposed on the underside of the frame to keep the frame free from marine growth.

While the invention has been described in connection with its preferred embodiments it should be recognized that changes and modifications may be made therein without departing from the scope of the appended claims.

What is claimed is:

1. An apparatus for inhibiting and removing barnacles, fungi, plankton and other marine deposits from the submerged hull portion of a watercraft, said apparatus comprising:

a submergible frame having a plurality of sections extending longitudinally and transversely slanted to substantially contour said submerged hull portion of said watercraft when said submergible frame is in a preparatory position prior to use;

a plurality of vertical posts, said submergible frame is attached to said plurality of vertical posts;

a rack and pinion gear assembly operably attached to said plurality of vertical posts for vertically moving said submergible frame up and down to a desired height;

a plurality of nozzles disposed on an upper surface of said plurality of sections in facing relation to said submerged hull portion of said watercraft;

an air compressor operably connected to said plurality of nozzles with a combination of valves and hose means and providing compressed air to said plurality of nozzles directing a stream of air bubbles towards and against said submerged hull portion of the watercraft; and, a timer for periodically shutting down the air compressor and stopping the flow of air to said plurality of nozzles.

2. An apparatus for inhibiting and removing barnacles, fungi, plankton and other marine deposits from a submerged portion of a watercraft according to claim 1, wherein said submergible frame is positioned at about 40 cm below the lowest point on said submerged hull portion of the watercraft.

3. An apparatus for inhibiting and removing barnacles, fungi, plankton and other marine deposits from a submerged portion of a watercraft according to claim 2, wherein said submergible frame is made of stainless steel.

4. An apparatus for inhibiting and removing barnacles, fungi, plankton and other marine deposits from a submerged portion of a watercraft according to claim 3 further comprising a solar source of energy for charging a battery to power said air compressor.

* * * * *